US007831009B2

(12) United States Patent
Alvord et al.

(10) Patent No.: US 7,831,009 B2
(45) Date of Patent: Nov. 9, 2010

(54) TANTALUM WATER TARGET BODY FOR PRODUCTION OF RADIOISOTOPES

(75) Inventors: Charles W. Alvord, Farragut, TN (US); Andy Williamson, Knoxville, TN (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 240 days.

(21) Appl. No.: 10/671,086

(22) Filed: Sep. 25, 2003

(65) Prior Publication Data

US 2005/0084055 A1 Apr. 21, 2005

(51) Int. Cl.
*G21G 1/10* (2006.01)

(52) U.S. Cl. ..... 376/195; 376/189; 376/198; 376/201

(58) Field of Classification Search ..... 376/194, 376/195, 202, 190, 156, 199, 198, 201
See application file for complete search history.

(56) References Cited

U.S. PATENT DOCUMENTS

| | | | | |
|---|---|---|---|---|
| 5,280,505 | A | 1/1994 | Hughey et al. | 376/156 |
| 5,425,063 | A | 6/1995 | Ferrieri et al. | 376/195 |
| 5,586,153 | A | 12/1996 | Alvord | 376/196 |
| 5,917,874 | A | 6/1999 | Schlyer et al. | 376/194 |
| 6,187,274 | B1 * | 2/2001 | Nilsson | 422/180 |
| 6,275,284 | B1 * | 8/2001 | Kiel et al. | 356/28 |
| 6,289,071 | B1 | 9/2001 | Fujiwara et al. | 376/195 |
| 6,359,952 | B1 | 3/2002 | Alvord | 376/202 |
| 6,433,495 | B1 | 8/2002 | Wibert | 315/502 |
| 6,483,118 | B2 | 11/2002 | Fujiwara et al. | 250/423 |
| 6,567,492 | B2 | 5/2003 | Kiselev et al. | 376/195 |
| 6,586,747 | B1 | 7/2003 | Erdman | 250/432 |
| 6,845,137 | B2 * | 1/2005 | Ruth et al. | 376/195 |
| 7,512,206 | B2 * | 3/2009 | Wieland | 376/195 |
| 2003/0007588 | A1 | 1/2003 | Kiselev et al. | 376/195 |
| 2003/0010619 | A1 | 1/2003 | Hyodo et al. | 204/157.2 |
| 2008/0023645 | A1 * | 1/2008 | Amelia et al. | 250/432 R |

OTHER PUBLICATIONS

Proceedings of the Ninth International Workshop on Targetry and Target Chemistry, May 23-25, 2002, Turku, Finland, Edited by Sven-Johan Heselius et al. Pages 3-7, and 12-16.*

Proceedings of the 8TH Workshop on Targetry and Target Chemistry, St. Louis, Missouri, USA, Jun. 23-26, 1999, pp. 53-56.*

Professor Stern, Fred, Chapter 6: Viscous Flow in Ducts, available @ http://css.engineering.uiowa.edu/~me_160/lecture_notes/Ch6Aug2005.pdf, last accessed Oct. 19, 2005.*

Recktenwald, Gerald, Fully-Developed Flow in a Pipe: A CFD Solution, Jan. 9, 2002, available @http://www.me.pdx.edu/~gerry/class/ME448/codes/fullyDevelopedPipeFlow.pdf, last accessed Oct. 19, 2005.*

(Continued)

*Primary Examiner*—Ella Colbert
*Assistant Examiner*—Daniel L Greene, Jr.
(74) *Attorney, Agent, or Firm*—Peter Kendall

(57) ABSTRACT

An apparatus for containing and cooling enriched water for the production of activated fluorine ($^{18}F$). A target assembly includes internal cooling channels in which developed flow of a coolant removes the heat from the target liquid in the target chamber. In one embodiment, the target assembly is fabricated of tantalum.

13 Claims, 3 Drawing Sheets

OTHER PUBLICATIONS

Definition of the term "adjacent", "alongside", "beside", "channel", "conduit", "nearby"; pp. 14, 32, 108, 190, 240 and 774 respectively, Merriam-Webster's Collegiate Dictionary, Tenth Edition Copyright 2001.*

Wolf et al., pp360,Radiopharmaceuticals and Labelled Compunds vol. I, IAEA, Vienna 1973.*

Definition of the term "natural circulation" from Engineers Edge,available online @ http://www.engineersedge.com/fluid_flow/conditions_required_natural_circulation.htm, last accessed Oct. 28, 2005.*

Tilbury, R.S "Fluorine-18 Production for Medical Use by Helium-3 Bombardment of Water", International Journal of Applied Radiation and Isotopes, 1970, vol. 21, pp. 277-281.*

Satyamurthy annotated, Full Satyamurthy article already of record.*

Schuster, Thomas. (Nov. 26, 2001). Junior companies target tantalum prospects. The Northern Miner,p. B1,B2+. Retrieved Jul. 18, 2010, from Business Dateline. (Document ID: 358529231).*

Satyamurthy et al., Tantalum [18O] Water Target for the Production of [18F] Fluoride with High Reactivity for the Preparation of 2-Deoxy-2{18F] Fluoro-D-Glucose, Molecular Imaging and Biology, Jan.-Feb. 2002, pp. 65-70, vol. 4.

* cited by examiner

TANTALUM WATER TARGET BODY FOR PRODUCTION OF RADIOISOTOPES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to the field of target assemblies for use with accelerators for the production of radioisotopes. More particularly, this invention pertains to target assemblies, which have less than ideal thermal conductivity, having internal cooling channels and thermally optimized target chambers.

2. Description of the Related Art

Positron Emission Tomography (PET) is a powerful tool for diagnosing and treatment planning of many diseases wherein radioisotopes are injected into a patient to diagnose and assess the disease. Accelerators are used to produce the radioisotopes used in PET. Generally, an accelerator produces radioisotopes by accelerating a particle beam and bombarding a target material, housed in a target system, with the particle beam.

Several factors must be considered when developing a target system for the production of radioisotopes. In the case of gas or liquid targets, the target material must be maintained at an elevated pressure during bombardment to compensate for the effects of density reduction of the target material due to heating/expansion/phase change (boiling). Further, it is desirable to operate at higher beam currents to increase production of the radioisotopes. Because of the amount of heat generated during bombardment, cooling the target material and other components of the target system is of significant importance.

Enriched water targets are used for the commercial production of the short lived ($t_{1/2}$=109.8 minutes) positron emitter fluorine-18 ($^{18}F$) for use as a tracer for Positron Emission Tomography (PET). The desired isotope is produced by proton bombardment of $^{18}O$ enriched water (enrichment typically above 95%), using the $^{18}O(p,n)^{18}F$ reaction. The $^{18}F$ isotope is used to produce fluorodexyglucose (FDG), which, when introduced within a patient, is used to map metabolic rates in the patient.

The cost of the enriched water and the short half-life of $^{18}F$ drive competing constraints on the target design. In order to overcome decay losses the target production must be maximized. This requires the target assemblies be designed for maximum operating current, which also increases ionization heating of the bombarded water. In order to minimize cost of reagents (specifically the expensive enriched water), the target assemblies necessarily have a small volume (<2 ml). Typical volume averaged power density in such targets is 400 W/cc. However peak power densities can be as much as two orders of magnitude greater.

FIGS. 1 and 2 illustrate perspective views of a prior art target assembly 110 showing the front surface 112 and rear surface 212, respectively. FIG. 3 is a cross-sectional view of the target assembly 110. The target assembly 110 has a front face 112, which is adapted to connect to an accelerator or cyclotron. The target assembly 110 has a cylindrical body which fits into a cylindrical slot which supplies cooling water to the target assembly 110. The target assembly 110 also has a rear face 212, which has connections 220, 222 for the enriched water and openings for securing 214, 216 the target assembly 110.

The prior art target assembly 110 includes a target chamber 104 encased in silver and having cooling channels 102, 102', 202, 204, 302, 304 along the outside surface of the target assembly 110. Typically, cooling water flows into the channel 102' on the bottom of the target assembly 110, through the channels 302, 304 along the circumference of the target assembly 110 and the channels 202, 204 along the rear surface 212 of the target assembly 110, and collecting in the channel 102 on the top of the target assembly 110, where it is removed and run through a heat exchanger to remove the collected heat. The channels 302, 304 are formed between the fins 306, 308 positioned around the circumference of the target assembly 110. In the illustrated prior art target assembly 110, the first fin 306 is separated from the other fins 308 by a larger gap, or channel, 302 in order to allow the target assembly 110 to receive a fastener.

The prior art target assembly 110 includes a target chamber 104, which is filled with enriched water via an inlet port 220 on the back side 212. The target chamber 104 is sealed with a window 310 adjacent the front face 112. The inlet port 220 feeds an inlet channel 106, through which the enriched water enters and fills the target chamber 104. The air pushed out of the target chamber 104 exhausts through the outlet port 222. Before being irradiated, the enriched water completely fills the target chamber 104.

The prior art target assembly 110 is fabricated from a silver ingot and operates at approximately 600 watts (10 MeV protons at 60 μA) on the target water. Irradiation of $^{18}O$-water in silver target bodies with proton beam currents higher than 30 μA generally leads to formation of gray or black colloids which frequently clogs the $^{18}F$ ion delivery lines. More importantly, the reactivity of the $^{18}F$ ion thus obtained is severely diminished. A model of the prior art target assembly 110 has been generated. This model of the external coolant cycle exposed inefficient cooling mechanisms, opportunities for coolant dryout, and likelihood of flow instabilities.

Silver target assemblies 110 oxidize under the conditions seen in a high pressure water target, and eventually this oxidation leads to failure of the system, both through increased temperature drops through the oxide, sequestering of the fluoride product on the oxide surface, and oxide particles fouling the product capillary tubing and subsequent synthesis into the desired tracer. At high currents, such as 40-60 μA, the silver target holders are typically only usable for 20 to 30 runs to create radioisotopes such as Flourine-18 before being too contaminated for further use to maintain sufficiently pure radiochemicals. At that point the target assembly must be removed from the accelerator and cleaned to recover functionality.

Various factors effect the production of radioisotopes from liquid targets with low energy accelerators. One such factor includes the configuration of the holding assemblies that retain the liquid target during the irradiation process. The holding assemblies must withstand severe environments created during the irradiation process and also enable the production of contaminant-free radiochemicals. When the liquid target is irradiated, the proton beam quickly heats the liquid target and creates high pressure within the target holder. The target holder must be capable of withstanding the elevated pressures without rupturing and without removing too much energy from the proton beam. Conventional liquid target holders have a thin front window through which the proton beams must pass before hitting the liquid target. Thicker windows are desirable to withstand the pressures generated from heating the liquid, but the thicker windows provide more mass through which the proton beam must pass before reaching the target. Accordingly, the thicker windows absorb more beam energy, thereby decreasing the effectiveness of the proton beam. When a low energy beam is used, it is highly desirable to ensure that as much energy remains in the proton beam as possible by the time it reaches its liquid target to maximize the beam's efficiency for irradiating the liquid target. So, while the strength of the thick window is desired, the resulting energy decrease in the beam is not.

Another factor includes providing a liquid target that will fully absorb the remaining energy of the proton beam. As the proton beam is passed into the target holder and the target liquid, the target liquid must have a sufficient depth or thickness so as to fully absorb the particles from the beam. If the proton beam passed completely through the liquid target and the target holder, the particle beam could create a radioactive environment external to the holding assembly.

Another significant factor in forming the radioisotopes or radiochemicals is controlling the target liquid's temperature during the irradiation process. When the proton beam bombards the target liquid, the temperature of the target liquid quickly increases. Heat must be efficiently drawn from the target liquid to maximize the effective density of the target liquid.

The quantity of radioisotopes produced in a liquid target is very small (e.g., an isotope concentration in the target may be in the order of $10^{-12}$), so it is important that the target body not introduce contaminants into the target material. Such contaminants would reduce the quantity of the available useful radioisotopes, and hinder the subsequent chemical processes in incorporating the radioisotope into the desired radiochemical.

Removal of the heat generated in the target is a significant problem that limits the magnitude of the incoming beam's current and hence, the production rate. Higher production rates are achieved if beams with higher currents can be used. Prior art target holders have been made of silver, which has a high thermal conductivity that allows heat to be quickly drawn from the liquid target. The silver target holders, however, often introduce impurities such as silver oxides that can react with or impede the reaction of the radiochemical formed in the target holder.

A description of water targets is provided in an article titled "Tantalum [$^{18}$O] Water Target for the Production of [$^{18}$F] Fluoride with High Reactivity for the Preparation of 2-Deoxy-2-[$^{18}$F]Fluoro-D-Glucose," by N. Satyamurthy, Bernard Amarasekera, C. William Alvord, Jorge R. Barrio, Michael E. Phelps, in Molecular Imaging and Biology, Vol. 4, No. 1, at 65-70 (2002). This article describes the use of tantalum for the body of the water target and discloses some of the disadvantages and problems of the prior art silver target assemblies. The article further discloses the lower heat conductivity of tantalum, along with its chemical inertness, radiochemical reactivity, and low induced activation. FIG. 1 of the article illustrates that the target assembly is cooled by heat transfer into a cooling water plenum located inside the assembly. Test results using tantalum show an average actual yield of 112.7 mCi/μA for the nine runs over 60 minutes in duration. This yield is 68.3% of the theoretical yield. None of the documented tests had a beam current above 40 μA and the beam energy was at 10.8 MeV.

An example of target cooling is disclosed in U.S. Pat. No. 5,917,874, titled "Accelerator Target," issued to Schlyer, et al. on Jun. 29, 1999, which discloses a target 14 with radial cooling fins 28. The Target 14 contains a sample 12 in the front side and a cooling system on the back side. The cooling system includes an integral solid cone 42 with a grouping of radial fins 28 disposed on the outer surface of the cone 42 to increase the surface area for cooling. A water jet 40*a* is directed at the apex 42*a* of the cone 42 from a single center inlet 40*d*. The coolant 40*a* flows along the cone 42 and radial fins 28, through a plenum 40*c*, and out a pair of outlets 40*e*.

U.S. Pat. No. 6,586,747, titled "Particle Accelerator Assembly With Liquid-Target Holder," issued to Erdman on Jul. 1, 2003, discloses a target assembly 12 with two windows 62, 64. The target cavity 60 has a front window 62, formed of Havar, through which the particle beam 17 passes. The target cavity 60 has a thin rear window 64, formed of a thin section of the holder body 56, formed of niobium, which separates the target cavity 60 from the cooling channel 74. Transfer of the heat from the target cavity 60 is through the rear window 64 and by passing cooling fluid through the cooling block 68 and over the rear window 64. The cooling block 68 is mounted to the holder body 56 and has support ribs 72 that form parallel cooling channels 74 through which the cooling fluid flows. The target cavity 60 is at an angle to the particle beam 17, thereby allowing the particle beam 17 to pass through a greater thickness of the target fluid 54, which allows for using higher energy particle beams 17.

BRIEF SUMMARY OF THE INVENTION

According to one embodiment of the present invention, a target assembly is provided. The target assembly includes channels in which developed flow of a coolant removes the heat from the target liquid. In one embodiment, a pair of parallel channels provide cooling. In another embodiment, the target assembly is fabricated out of tantalum, which allows for higher current proton beams to be applied to the target liquid without reducing the life of the target assembly or introducing contaminants in the target liquid. In still another embodiment, the target chamber is shaped to promote natural circulation of the target liquid as it undergoes bombardment.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An apparatus for containing and cooling a liquid target is disclosed. The apparatus, a target assembly 10, has a chamber in which enriched water is irradiated with a proton stream.

Figure 1:
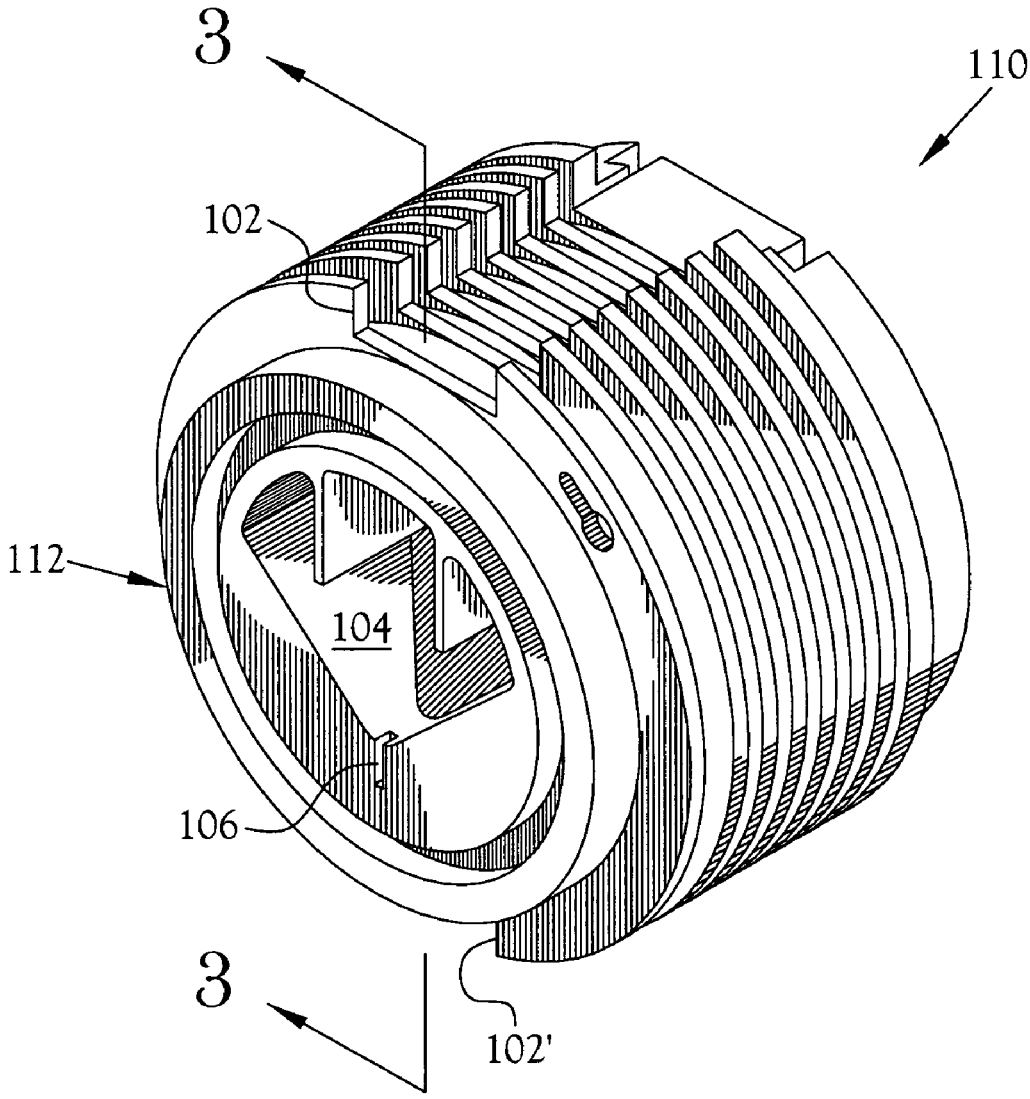
Fig.1 (PRIOR ART)
FIG. 1 is a front perspective view of a prior art target assembly.
Figure 2:
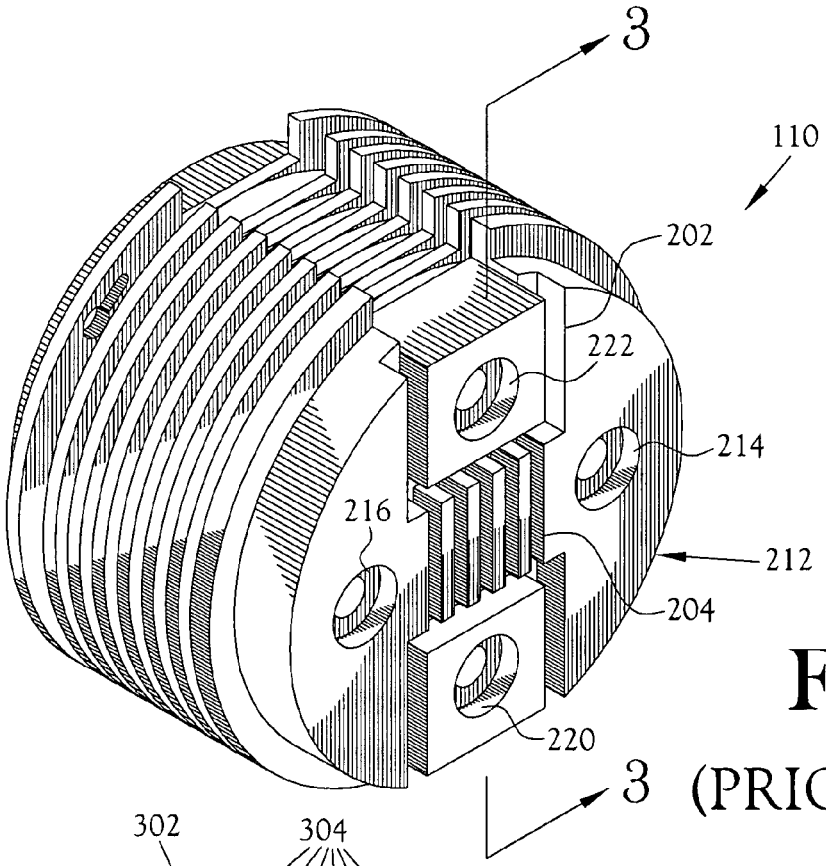
Fig.2 (PRIOR ART)
FIG. 2 is a rear perspective view of the prior art target assembly.
Figure 3:
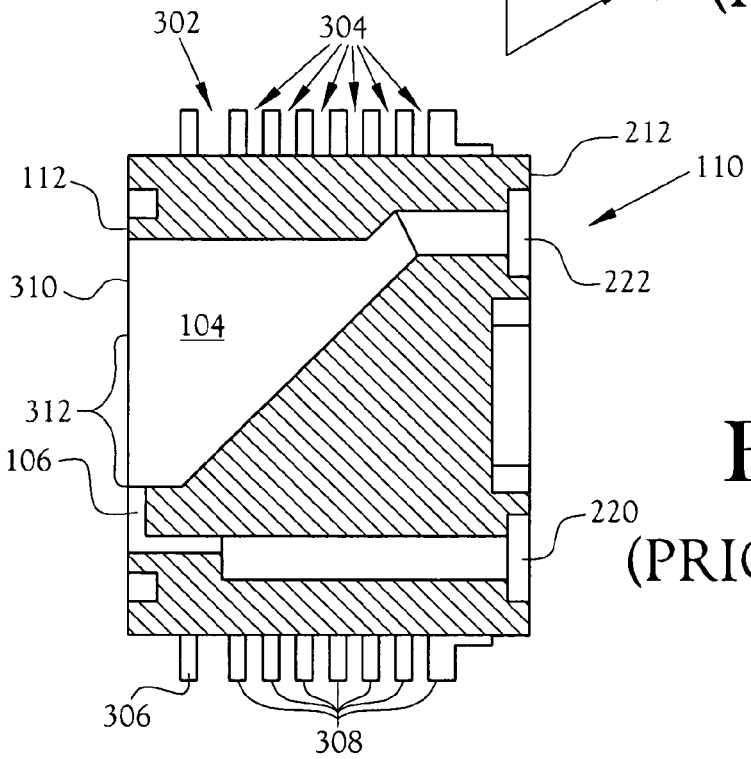
Fig.3 (PRIOR ART)
FIG. 3 is a cross-sectional view of the prior art target assembly.
Figure 4:
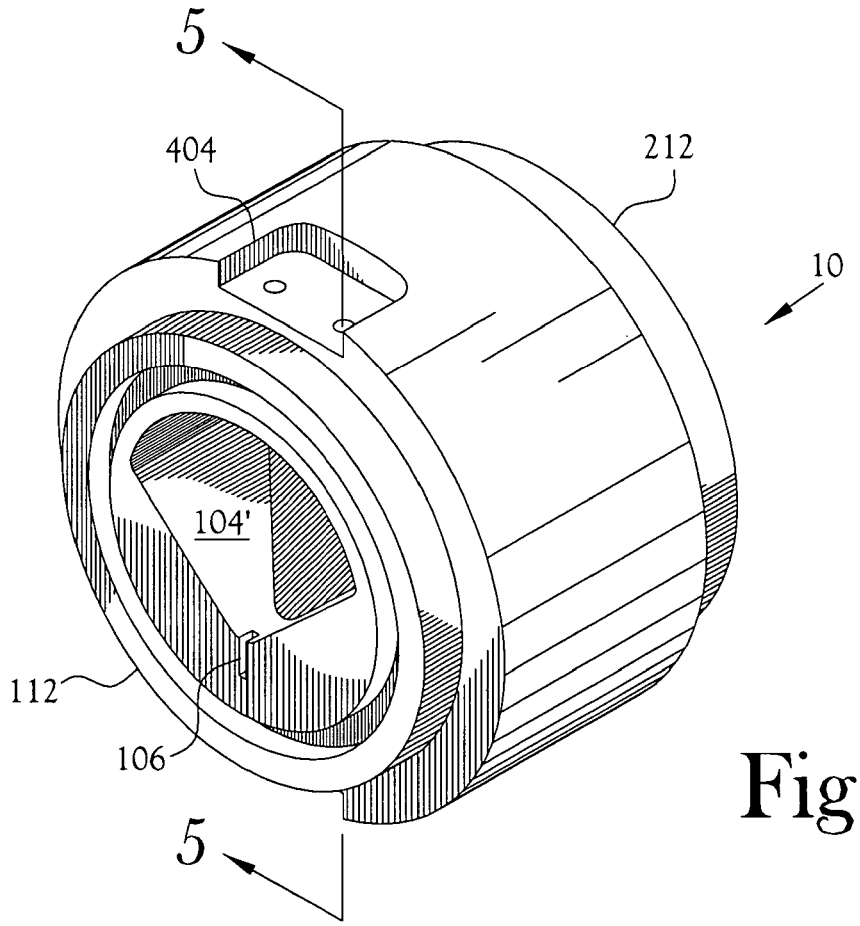
FIG. 4 is a front perspective view of one embodiment of a target assembly.
Figure 5:
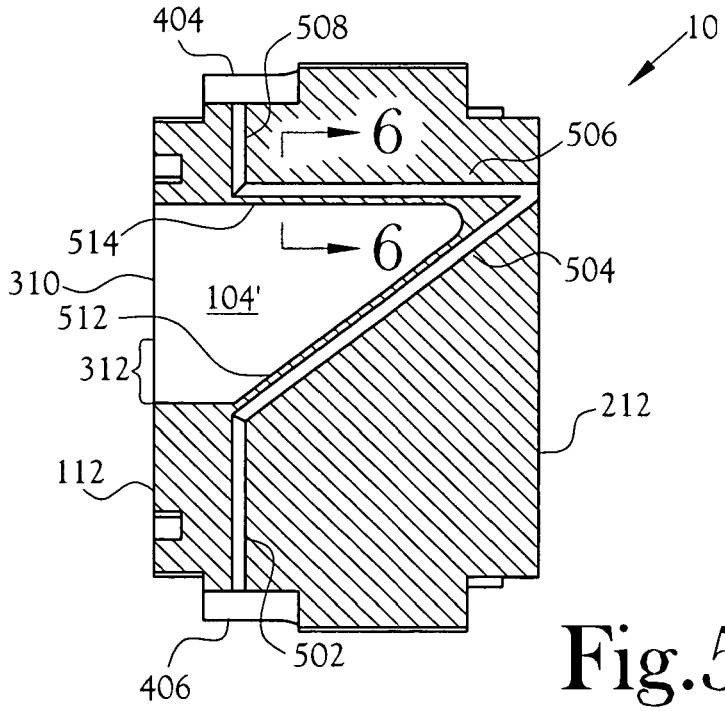
FIG. 5 is a cross-sectional view of one embodiment of a target assembly along the axis 5-5 as shown in FIG. 4.

FIGS. 4 and 5 illustrate one embodiment of the present invention. The target assembly 10 has a target body with a relatively solid outside surface with an upper flow channel 404 and a lower flow channel 406 through which cooling water can be provided. The target chamber 104' has a front window 310 approximating a one-quarter circle, and the target chamber 104' extends into the target assembly 10 with a sloping, or canted, rear wall 512 to allow for expansion of a vapor jet adjacent to the beam strike area 312 of the entrance window 310. The target liquid is introduced into the target assembly 10 through port 106, located at the lower portion of the target chamber 104' and extending into the front face 112 of the target assembly 10. The target assembly 10 contains the same inlet and outlet ports 220 and 222 as shown in FIGS. 2 and 3.

In one embodiment, the target assembly 10 is fabricated of tantalum, which has superior oxidation resistance compared to silver, but poorer thermal conductivity. Silver has high thermal conductivity of 415 W/m-K, whereas tantalum has a lower thermal conductivity of 57 W/m-K. Target assemblies fabricated of silver encounter oxidation problems with beam currents above 60 μA. Target assemblies 10 of tantalum have been tested up to 100 μA (1000 W at 10 MeV) and have provided excellent longevity and increased output at heretofore unattainably high production levels.

FIG. 5 illustrates a section of the target 10 through one of two parallel channels 502, 504, 506, 508, each off center relative to the vertical midplane of the target 10. Each of the two channels are defined by 4 blind holes 502, 504, 506, 508, which, in one embodiment, are drilled into the target assembly 10. In one embodiment, the 4 blind holes 502, 504, 506, 508 are each 0.067" diameter and are approximately 0.180" off the vertical midplane of the target 10.

In operation, the target liquid is introduced into the target chamber 104' through the port 106. Cooling water is pumped from the lower channel 406, through the two parallel channels 502, 504, 506, 508, and into the upper channel 404. The target liquid is irradiated and the heat is removed by the cooling water flowing through the channels 502, 504, 506, 508. In particular, a high Reynolds number flow path through the two parallel channels 504, 506 cool the horizontal upper condenser plate surface 514 and the canted back wall 512 inside the beam strike, thereby compensating for the low thermal conductivity of the tantalum target assembly 10.

The target assembly 10 includes a target chamber 104', which is filled with enriched water via an inlet port 220 on the back side 212, as shown in FIG. 3. The target chamber 104' is sealed with a window 310 adjacent the front face 112. The inlet port 220 feeds an inlet channel 106, through which the enriched water enters and fills the target chamber 104'. The air pushed out of the target chamber 104' exhausts through the outlet port 222. Before being irradiated, the enriched water completely fills the target chamber 104'. The accelerator beam strikes the target chamber 104' at a circular region 312 (the beam strike) in the lower portion of the chamber 104'. The beam heats the window 310 and the enriched water in the immediate vicinity of the window 310. The window 310 is typically Havar and is elevated to a high temperature by the beam. The window 310 transfers some of its heat to the water, which is also being heated by the beam. The enriched water experiences localized boiling adjacent to the window 310 at the beam strike area 312, which causes a jet of superheated steam to form. The jet moves upward, into a stable steam bubble in the top portion 514 of the target chamber 104'. The enriched water circulates in the target chamber 104' from the target strike area 312, to the top portion 514 of the target chamber 104', where it is condensed, down the back wall 512 and the side walls of the chamber 104' and toward the front window 310, where the enriched water re-enters the beam strike area 312 and is reheated, continuing the cycle.

The cooling water enters the lower channel 502 and passes through the channel 504 adjacent the rear wall 512 of the target chamber 104'. The cooling water, which is warmer after passing by the rear wall 512, then passes through the channel 506 adjacent the upper wall 514 of the target chamber 104' and then out of the target assembly 10 through the upper channel 508. The cooling water progressively heats as it moves through the channels 502, 504, 506, 508, thereby presenting the enriched water at the back wall 512 with the coolest water possible. The differential temperature between the enriched water and the cooling water is maximized by having the cooling water enter at the bottom. Further, the developed flow of the cooling water allows for greater heat transfer from the target assembly 10.

The embodiment of the target chamber 104' illustrated in FIG. 5 has a configuration that aids the cooling of the enriched water by allowing for natural circulation of the enriched water. In one embodiment, the function of containing the target liquid for irradiation is performed by the target chamber 104' within the target body. In another embodiment, the function of containing the target liquid for irradiation is performed by the target chamber 104', which includes the arcuate upper wall 514 and the back wall 512. In one embodiment, the function of cooling the target assembly 10 is performed by at least one cooling channel 506 adjacent to and parallel to the upper wall 514, with the cooling channel 506 having developed flow. In another embodiment, the function of cooling the target assembly 10 is performed by at least one set of cooling channels 504, 506 adjacent to and parallel to the back wall 512 and the upper wall 514, respectively, with the cooling channels 504, 506 having developed flow.

In one embodiment, the function of inducing fluid flow within the target chamber 104' is accomplished by the shape of the target chamber 104'. In another embodiment, the function of inducing fluid flow within the target chamber 104' is accomplished with the front window 310 having a larger area than the beam strike area 312, the curved upper wall 514, and the canted back wall 512.

In one embodiment, the flow is adjusted to 0.25 gpm through each of the two parallel channels 502, 504, 506, 508 and for a 5 psi drop. The Reynolds number calculated for this configuration is 11799, indicating a truly turbulent regime. The flow is fully developed in the slanted channel 504, and nearly fully developed in the top horizontal channel 506. The pressure available in the target assembly 10 is being used more efficiently than in the prior art. The pressure drop along the two channels 504, 506 sums to 4.73 psi. These numbers also compare favorably with an inlet dynamic head of 0.04 psi, indicating that flow instabilities from entrance conditions are less likely. The target assembly 10 has heat transfer coefficients of 32,019 W/m2-K, owing to the turbulent diffusion of thermal energy. This gives much lower and more realistic temperature drops in the boundary layer, and a reasonable 3.81 degrees Celsius increase in water temperature over the course of the flow.

Figure 6:
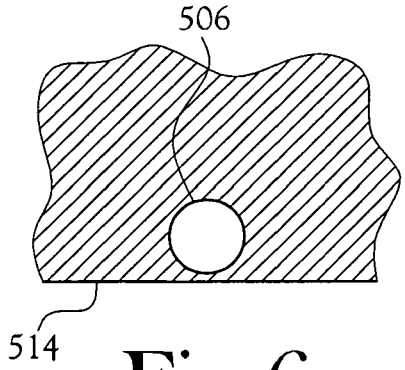
FIG. 6 is a cross-sectional view of the upper cooling channel and the target chamber.

FIG. 6 is a cross-sectional view illustrating one of the parallel upper channels 506 and the top surface 512 of the target chamber 104'. The enriched water in the target chamber 104', in one embodiment, is pressurized to 600 psi. The circular cross-section of the channels 504, 506 allows the channels 504, 506 to be close to the surface of the target chamber to maximize heat transfer while still allowing the target chamber 104' to contain an elevated pressure without rupturing. With the low heat transfer rate of tantalum, cooling efficiency is increased by locating the channels 504, 506 as close as possible to the back and upper walls 512, 514 of the target chamber 104'.

The shorter conduction paths 504, 506 and more optimal cooling enables operation of target assemblies 10 with materials such as tantalum, which are less desirable from the standpoint of thermal conductivity, but have superior chemical properties. The complexity of the target assembly 10 has also been reduced, compared to the prior art target assembly 110.

Extensive testing of the illustrated embodiment of the target assembly 10 has been conducted. The tested target assembly 10 was constructed of tantalum. With 48 runs of over 60 minutes duration, the average actual yield of 130.7 mCi/μA. This yield is 84.5% of the theoretical yield, which is much greater than the yield achieved from the target assembly described in the Satyamurthy article.

The Satyamurthy article used an RDS-112 accelerator, which has a beam energy, after passing through all of the entrance foils, of approximately 10.8 MeV. At that energy, the theoretical yield of the $^{18}F$ production in $^{18}O$ enriched water is 165 mCi/μA at saturation. In the bombardments over 60 minutes in duration (n=9), the average saturation yield obtained with the configuration of the target assembly disclosed in the Satyamurthy article was 112.7 mCi/μA at saturation, or 68.3% of theoretical.

The tested target assembly 10 was operated with a gridded window support which intercepts beam current, so an additional correction factor of 0.91 was applied to the beam current. With this correction, the average saturation yield of the bombardments over 60 minutes in duration (n=48) was 130.7 mCi/μA at saturation. The tested embodiment had currents of 60 to 100 μA. The accelerator these bombardments were performed with, the RDS Eclipse, has a beam energy of about 10.3 MeV after passing through all foils. At that lower energy than the accelerator used for the Satyamurthy experiments, the theoretical yield is 154.7 mCi/μA at saturation. Therefore tested target assembly 10 achieves 84.5% of theoretical yield, even though the beam current is much higher than the target assembly used in the Satyamurthy article. This high yield with tantalum is an unexpected benefit. Although known in the art, the use of tantalum, in combination with the cooling system described herein, provides unexpected results considering the low heat coefficient of tantalum and the use of higher beam currents.

From the foregoing description, it will be recognized by those skilled in the art that a novel target assembly has been provided. The target assembly is fabricated of tantalum, which has superior oxidation resistance, and has cooling channels utilizing minimal conduction paths and high Reynolds number flows, which permits the target assembly to operate at high beam currents. The higher beam currents, along with the oxidation resistance, increases the performance and production capabilities over the prior art target assemblies.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

We claim:

1. A target assembly for containing and cooling enriched water for the production of fluorine-18, comprising:

a target body;

a target chamber formed within said target body, said target chamber having a front window for exposing said chamber to a particle accelerator, a rear wall opposite said front window, said rear wall being sloped with respect to said front window, and a top wall connecting said rear wall to said front window; and a first cooling channel having a first cooling fluid inlet at one end of said target body, a first cooling fluid outlet at another end of said target body, and a first cooling fluid channel conduit formed within said target body coupling said first cooling fluid inlet with said first cooling fluid outlet, said first cooling fluid channel conduit running from said first cooling fluid inlet to a first location adjacent to said rear wall, from said first location to a second location between said rear wall and said top wall along said rear wall, from said second location to a third location adjacent to said top wall along said top wall, and from said third location to said first cooling fluid outlet.

2. A target assembly as set forth in claim 1, further comprising:

a second cooling channel having a second cooling fluid inlet at one end of said target body, a second cooling fluid outlet at another end of said target body, and a second cooling fluid channel conduit formed in said target body coupling said second cooling fluid inlet with said second cooling fluid outlet, said second cooling fluid channel conduit running substantially parallel to said first cooling fluid channel conduit.

3. A target assembly as set forth in claim 1, wherein said target body is fabricated substantially from tantalum.

4. A target assembly as set forth in claim 1, further comprising an enriched water inlet port formed in said target body, an enriched water inlet channel coupled between said target chamber and said enriched water inlet port, an enriched water outlet port formed in said target body, and an enriched water outlet channel coupled between said target chamber and said enriched water outlet port.

5. A target assembly as set forth in claim 4, wherein said enriched water inlet port is located at an outer surface of said target body, said outer surface being substantially parallel to said front window.

6. A target assembly as set forth in claim 4, wherein said enriched water outlet port is located at an outer surface of said target body, said outer surface being substantially parallel to said front window.

7. A target assembly as set forth in claim 4, wherein said enriched water inlet port is located at an outer surface of said target body, said outer surface being substantially parallel to said front window, and said enriched water outlet port also is located at said outer surface of said target body.

8. A target assembly for containing and cooling enriched water for the production of fluorine-18, comprising:

a target body;

a target chamber formed within said target body, said target chamber having a front window for exposing said chamber to a particle accelerator, a rear wall opposite said front window, said rear wall being sloped with respect to said front window, and a top wall connecting said rear wall to said front window;

a first cooling channel having a first cooling fluid inlet at one end of said target body, a first cooling fluid outlet at another end of said target body, and a first cooling fluid channel conduit formed within said target body coupling said first cooling fluid inlet with said first cooling fluid outlet, said first cooling fluid channel conduit running from said first cooling fluid inlet to a first location adjacent to said rear wall, from said first location to a second location between said rear wall and said top wall along said rear wall, from said second location to a third location adjacent to said top wall along said top wall, and from said third location to said first cooling fluid outlet; and a second cooling channel having a second cooling fluid inlet at one end of said target body, a second cooling fluid outlet at another end of said target body, and a second cooling fluid channel conduit formed within said target body coupling said second cooling fluid inlet with said second cooling fluid outlet, said second cooling fluid channel conduit running substantially parallel to said first cooling fluid channel conduit.

9. A target assembly as set forth in claim 8, wherein said target body is fabricated substantially from tantalum.

10. A target assembly as set forth in claim 8, further comprising an enriched water inlet port formed in said target body, an enriched water inlet channel coupled between said target chamber and said enriched water inlet port, an enriched water outlet port formed in said target body, and an enriched water outlet channel coupled between said target chamber and said enriched water outlet port.

11. A target assembly as set forth in claim 10, wherein said enriched water inlet port is located at an outer surface of said target body, said outer surface being substantially parallel to said front window.

12. A target assembly as set forth in claim 10, wherein said enriched water outlet port is located at an outer surface of said target body, said outer surface being substantially parallel to said front window.

13. A target assembly as set forth in claim 10, wherein said enriched water inlet port is located at an outer surface of said target body, said outer surface being substantially parallel to said front window, and said enriched water outlet port also is located at said outer surface of said target body.

* * * * *